US010260505B2

(12) United States Patent
Block et al.

(10) Patent No.: US 10,260,505 B2
(45) Date of Patent: Apr. 16, 2019

(54) PUMP

(71) Applicant: E.G.O. ELEKTRO-GERÄTEBAU GMBH, Oberderdingen (DE)

(72) Inventors: Volker Block, Bretten (DE); Uwe Kögel, Kürnbach (DE); Stefanie Roth, Hambrücken (DE); Tobias Albert, Kraichtal (DE)

(73) Assignee: E.G.O. ELEKTRO-GERÄTEBAU GMBH, Oberderdingen (DE)

( * ) Notice: Subject to any disclaimer, the term of this patent is extended or adjusted under 35 U.S.C. 154(b) by 304 days.

(21) Appl. No.: 14/897,372

(22) PCT Filed: Feb. 17, 2014

(86) PCT No.: PCT/EP2014/053032
§ 371 (c)(1),
(2) Date: Dec. 10, 2015

(87) PCT Pub. No.: WO2014/198427
PCT Pub. Date: Dec. 18, 2014

(65) Prior Publication Data

US 2016/0169230 A1 Jun. 16, 2016

(30) Foreign Application Priority Data

Jun. 14, 2013 (DE) ..... 10 2013 211 180

(51) Int. Cl.
*F04D 1/00* (2006.01)
*F04D 13/06* (2006.01)
(Continued)

(52) U.S. Cl.
CPC ..... *F04D 1/00* (2013.01); *F04D 13/0606* (2013.01); *F04D 29/426* (2013.01); *F04D 29/4206* (2013.01); *F04D 29/586* (2013.01)

(58) Field of Classification Search
CPC .... F04D 1/00; F04D 13/0606; F04D 29/4206; F04D 29/426; F04D 29/586;
(Continued)

(56) References Cited

U.S. PATENT DOCUMENTS 3,552,888 A 1/1971 Ericksson
3,775,024 A 11/1973 Ulm et al.
(Continued)

FOREIGN PATENT DOCUMENTS

CN 101096953 A 1/2008
DE 1813676 12/1968
(Continued)

OTHER PUBLICATIONS

Translated Notice of Reason for Rejection dated Nov. 7, 2017 for JP Patent Application 2016-518871, a counterpart foreign application of U.S. Appl. No. 14/897,372, 4 pages.
(Continued)

*Primary Examiner* — Carlos A Rivera
*Assistant Examiner* — Justin A Pruitt
(74) *Attorney, Agent, or Firm* — Lee & Hayes, P.C.

(57) ABSTRACT

A pump for delivering fluid has a pump housing and a pump chamber having a pump chamber cover and a pump chamber base in said pump housing, an inlet and an outlet. In the pump chamber, an impeller rotates on a rotor shaft which is connected to a drive motor. The inlet is arranged in the pump chamber cover and the outlet is arranged below the impeller in the axial direction of the pump at that end region of the pump chamber which is remote from the inlet close to the outlet. The distance from the inlet to the outlet with the impeller therebetween can correspond approximately to the diameter of the pump chamber.

10 Claims, 5 Drawing Sheets

(51) Int. Cl.
*F04D 29/42* (2006.01)
*F04D 29/58* (2006.01)

(58) Field of Classification Search
CPC .. F04D 29/4293; F04D 29/448; F04D 29/588; F04D 29/5893; F05D 2250/52; F01D 1/00
See application file for complete search history.

(56) References Cited

U.S. PATENT DOCUMENTS

| | | | | |
|---|---|---|---|---|
| 4,224,009 | A | 9/1980 | Grandi | |
| 5,073,335 | A | 12/1991 | Townsend | |
| 5,595,473 | A | 1/1997 | Nagoka et al. | |
| 8,240,976 | B1 * | 8/2012 | Kamio | F04D 29/448 415/1 |
| 8,245,718 | B2 | 8/2012 | Busing et al. | |
| 8,358,922 | B2 | 1/2013 | Stickel | |
| 8,989,566 | B2 | 3/2015 | Liu et al. | |
| 2005/0196274 | A1 | 9/2005 | Kraffzik | |
| 2008/0044168 | A1 | 2/2008 | Eichholz et al. | |
| 2010/0126534 | A1 * | 5/2010 | Busing | A47L 15/4225 134/105 |
| 2013/0115070 | A1 | 5/2013 | Baumgartner et al. | |
| 2013/0216370 | A1 | 8/2013 | Roth et al. | |
| 2013/0230416 | A1 * | 9/2013 | Verma | A47L 15/4225 417/321 |
| 2013/0287561 | A1 | 10/2013 | Block et al. | |
| 2013/0343882 | A1 | 12/2013 | Albert et al. | |

FOREIGN PATENT DOCUMENTS

| | | | |
|---|---|---|---|
| DE | 2556341 | | 6/1977 |
| DE | DE2807645 | | 9/1978 |
| DE | 10325981 | | 12/2004 |
| DE | WO2012/062839 | A1 | 5/2012 |
| DE | 102012110304 | | 5/2013 |
| DE | 102012202491 | | 8/2013 |
| DE | 102012210554 | | 12/2013 |
| EP | 0984167 | | 3/2000 |
| EP | 1870508 | | 12/2007 |
| EP | 2150165 | | 2/2010 |
| GB | 1525169 | | 9/1978 |
| JP | 2006-046178 | A | 2/2006 |
| WO | WO2005055665 | A1 | 6/2005 |
| WO | WO2011091809 | | 8/2011 |

OTHER PUBLICATIONS

International Search Report from PCT/EP2014/053032 dated May 26, 2014, 3 pages.
English Translation of JP 2006-046178 published Feb. 16, 2006, 10 pages.

* cited by examiner

PUMP

This Application claims priority to DE 10 2013 211 180.0, filed Jun. 14, 2013, which is incorporated herein by reference.

FIELD OF APPLICATION AND PRIOR ART

The invention relates to a pump for delivering fluid, in particular in the form of an impeller pump or radial pump, as can be used, for example, in a water-bearing device or domestic appliance such as a dishwasher or a washing machine.

EP 2150165 discloses, in principle, a corresponding pump. Said pump has a pump housing with a pump chamber and also an inlet and an outlet which are arranged on a cover of the pump housing. An impeller which sits on a rotor shaft of the drive motor which is arranged below the base is arranged just above the base of the pump chamber. An outer wall of the pump chamber is heated and the fluid which flows along said outer wall is heated.

Problem and Solution

The invention is based on the problem of providing a pump of the kind cited in the introductory part with which problems of the prior art can be solved and, in particular, it is possible to construct a pump in a simple manner and such that it is fit for purpose and also to arrange said pump in a device or domestic appliance in a space-saving manner.

This problem is solved by a pump having the features of claim 1. Advantageous and preferred refinements of the invention are the subject matter of the further claims and will be explained in greater detail in the text which follows. The wording of the claims is included in the description by express reference.

Provision is made for the pump to have a pump housing, a pump chamber in the pump housing, and also an inlet and an outlet on the pump chamber. Furthermore, an impeller is provided in the pump chamber, it being possible for said impeller to be formed in a known manner in principle. The impeller is arranged on a drive shaft or rotor shaft and in this way is connected to a drive motor of the pump, in particular to the rotor of said drive motor. The pump chamber has a pump chamber cover and a pump chamber base, wherein these two terms are intended to be understood in the broad sense and substantially create or constitute a termination or a boundary of the pump chamber in the axial direction. However, they do not have to form the entire respective termination. The inlet is arranged in the pump chamber cover, preferably in the middle or axially and centrally in relation to a longitudinal center axis of the pump. The drive motor can advantageously be arranged below the pump chamber base or at least below a central region of a pump chamber base, that is to say adjacent to the pump chamber base in the axial direction and at a distance from the pump chamber cover or at a distance from the inlet.

According to the invention, provision is made for the outlet out of the pump chamber to be arranged below the impeller in the axial direction of the pump, that is to say preferably at that end region of the pump chamber which is remote from the inlet in the axial direction and close to the outlet. In the prior art in the form of EP 2150165 B1 cited in the introductory part, the inlet and the outlet are jointly arranged in the pump chamber cover. In this case, the impeller runs above the pump chamber base. Therefore, in the prior art, the inlet and the outlet are located approximately at the same axial height, specifically at a distance from the impeller, or else the outlet can be remote from the impeller in the axial direction beyond the inlet.

By virtue of the invention, the outlet is now, as it were, shifted in the axial direction, and the pump chamber is advantageously shifted with it as it were. In this case, the outlet is shifted in the axial direction away from the pump chamber cover or away from the inlet, and particularly advantageously also away from the impeller, but in the opposite axial direction from the inlet. Therefore, the pump chamber can preferably also extend in an annular manner starting from the impeller in the axial direction of the pump, specifically in a direction away from the inlet and, in this case, advantageously in a direction in which the fluid, which is to be delivered, in the inlet flows into the pump chamber.

In an advantageous refinement of the invention, a heating device is provided for the fluid which is delivered by the pump. This heating device can be integrated into the pump chamber, so that the fluid which is delivered or is located in the pump chamber flows directly against said heating device. A heating device can advantageously be designed in an annularly encircling manner. In this case, said heating device can form a pump chamber outer wall since, here, the circulating movement of the delivered fluid ensures that said fluid flows particularly well with particularly good heat transfer in a radial pump of said kind.

The impeller can advantageously be arranged just below the pump chamber cover. Therefore, said impeller can also be arranged just below the inlet.

Advantageously, no region of the pump chamber projects beyond the impeller in the axial direction toward the inlet. Therefore, the pump chamber cover actually substantially covers the end face of the pump chamber and also the entire end face of the pump chamber in the axial direction toward the inlet. This is indeed the case for the pump chamber base in the prior art cited in the introductory part.

In an advantageous refinement of the invention, the pump chamber, starting from the pump chamber cover, can extend away from the inlet in the axial direction, advantageously in a substantially annularly encircling manner. As seen in the axial direction, a pump chamber length can amount to 0.5 times to 1.5 times or even 2.5 times the largest diameter of the pump chamber. The maximum axial extent of the pump chamber length is preferably approximately the same size as the largest diameter. According to a further possibility, the pump chamber length along the axial direction can amount to 2 times to 5 times the axial length of the impeller. This also means that the pump chamber has a certain axial length. This is also necessary so that the abovementioned heating device can have a certain axial length and the delivered fluid can cover a certain distance along said heating device for heating purposes.

In a refinement of the invention, the impeller can be arranged above an end face of a projection or cylinder section or section which projects into the pump chamber. This section projects from an end of the pump which is remote from the pump chamber cover into the pump chamber in the axial direction and forms an inner wall of the pump chamber, in particular in a portion following the impeller in the axial direction. This section can be integrally connected to at least one part of the pump chamber outer wall, and in particular can form a pump chamber inner wall and then, as it were, turn in a reversal region and, in particular close to the outlet, form a part of the pump chamber outer wall in an encircling manner. The section can have a diameter similar to the diameter of the impeller, advantageously between 0.5 times to 1.5 times the diameter of the impeller or its lower covering plate.

The abovementioned rotor shaft on which the impeller sits and which is connected to the drive motor of the pump or forms a part of said drive motor can be guided by the abovementioned section. The section can contain at least one part of the drive motor of the pump. Therefore, a rotor of the drive motor, which rotor sits on the rotor shaft, can run in said section for example. A relatively large functional part of the drive motor may possibly also run in the section, preferably also radially within the outlet or radially within an outlet nozzle. In an alternative and preferred manner, the drive motor together with its functional parts can be arranged behind the outlet or outlet nozzle of the pump chamber in the axial direction.

In one refinement of the invention, the pump housing can be of three-part design. To this end, said pump housing can be formed by the pump chamber cover, a radially outer pump chamber wall which is advantageously formed by an abovementioned heating device, and the abovementioned cylinder section. In this case, the cylinder section can preferably be below the outlet and drawn upward radially toward the outside and extend bent over in the direction of the inlet as far as the radially outer pump chamber wall. This very complicated form can be easily realized using a plastic injection-molded part.

A guide wheel with at least one guide vane which runs along the outer face of the guide wheel can be provided on the cylinder section close to the end face or at a free end of the cylinder section above which the impeller is also arranged or above which said impeller runs at a short distance. In this case, the guide vane projects toward the outside, advantageously approximately or largely in the radial direction, and at least one part of the circumferential direction runs along the outer face. Said guide vane is inclined in comparison to a longitudinal axis through the rotor shaft, advantageously by 5° to 30°, particularly advantageously by 8° to 20°. The guide vanes preferably always project at the same distance from the outer face of the guide wheel or of the cover. However this can also be variable.

A cover can preferably be fitted onto the largely hollow cylinder section, wherein the at least one guide vane is arranged or integrally formed on the outside of the outer face on the cover. The cover advantageously has a passage and/or a mount for the rotor shaft in the central region. The impeller can be arranged at a short distance above the cover, for example at a distance of less than 5 mm.

The cover, in particular with the guide wheel, can have a bearing support for a running bearing of the rotor shaft. This bearing support can advantageously be a mount for a bearing bushing for the rotor shaft.

The cover and the guide wheel are advantageously designed off-center in relation to a longitudinal center axis through the rotor shaft or off-center in relation to an outer wall of the pump chamber. Said cover and guide wheel are particularly advantageously designed off-center just like the cylinder section.

In a further refinement of the invention, a delivery direction of the fluid delivered within the pump housing or within the pump can run such that it moves monotonically in one direction or has at least one axial component which moves monotonically in one direction. Therefore, the fluid never runs opposite to the inflow direction through the inlet into the pump chamber. This delivery direction in the pump can even always have an axial component along the axial direction or parallel to the inflow direction, that is to say run strictly monotonically. This is intended to apply until the delivered fluid leaves the pump chamber at the outlet. In this case, the delivered fluid in the impeller can also have an axial movement component which is always greater than zero. The impeller is then a so-called diagonal flow impeller and the pump is a diagonal flow pump.

In an alternative and advantageous manner, the impeller can be in the form of a purely radial impeller and therefore the pump can be in the form of a purely radial pump. A purely radial impeller is more efficient. The axial flow or axial component can be achieved by the shape of the pump chamber cover and the displacement of the water during the continuous delivery process in the case of purely radial design. Therefore, a delivery action for the fluid which is as good as possible can then be achieved in the pump.

These and further features are apparent not only from the claims but also from the description and the drawings, where the individual features can in each case be realized on their own or jointly in the form of subcombinations in an embodiment of the invention and in other fields and can constitute advantageous and inherently protectable embodiments for which protection is claimed here. The subdivision of the application into individual sections and sub-headings does not restrict the general validity of the statements made thereunder.

BRIEF DESCRIPTION OF THE DRAWINGS

Exemplary embodiments of the invention are schematically illustrated in the drawings and will be explained in greater detail in the text which follows. In the drawings:

FIG. 4 shows a modification to the pump in an illustration similar to

FIG. 3 with the drive motor drawn in the direction of the inlet, and

DETAILED DESCRIPTION OF THE EXEMPLARY EMBODIMENTS

Figure 1:
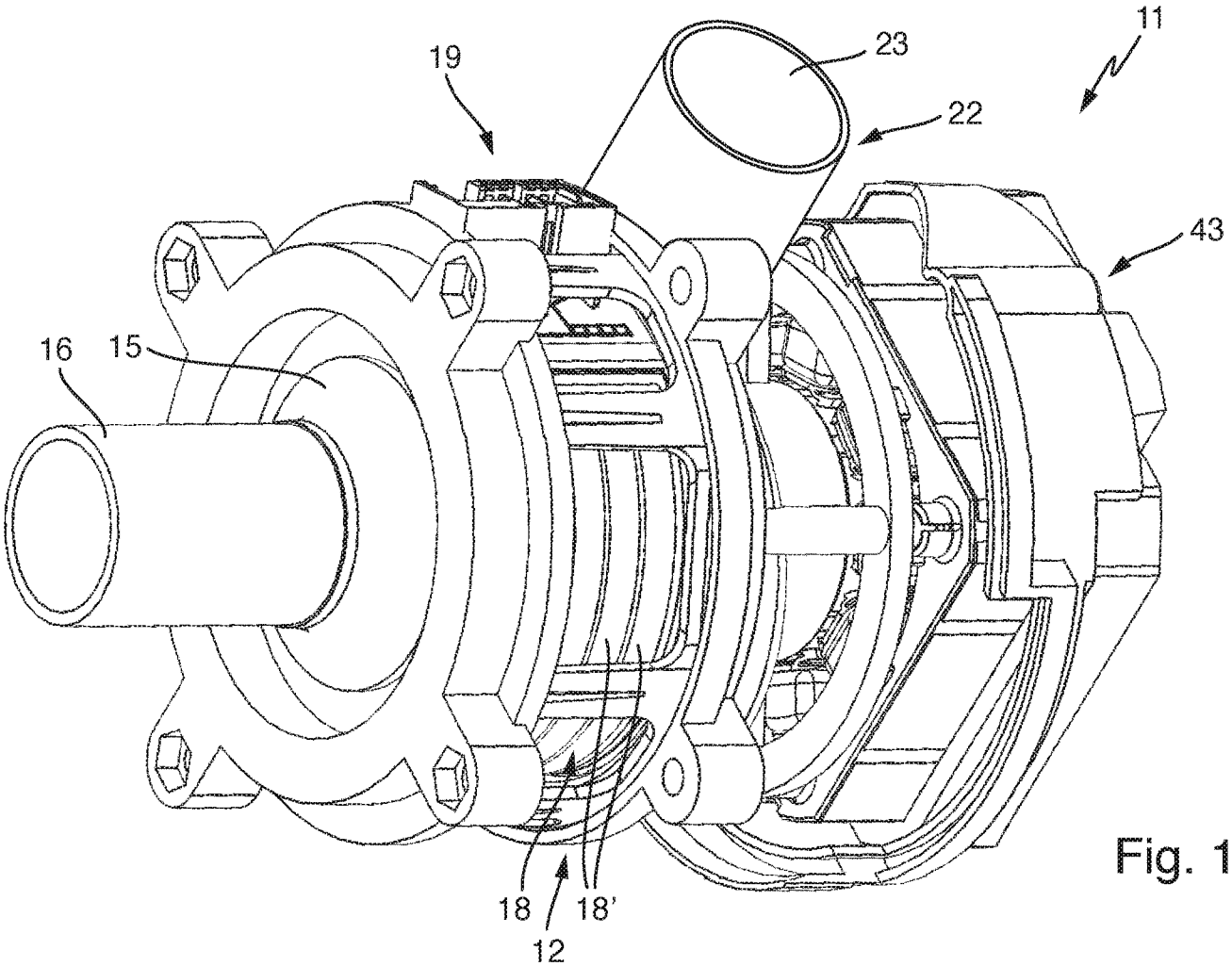
FIG. 1 shows an oblique view of a pump according to the invention.
Figure 2:
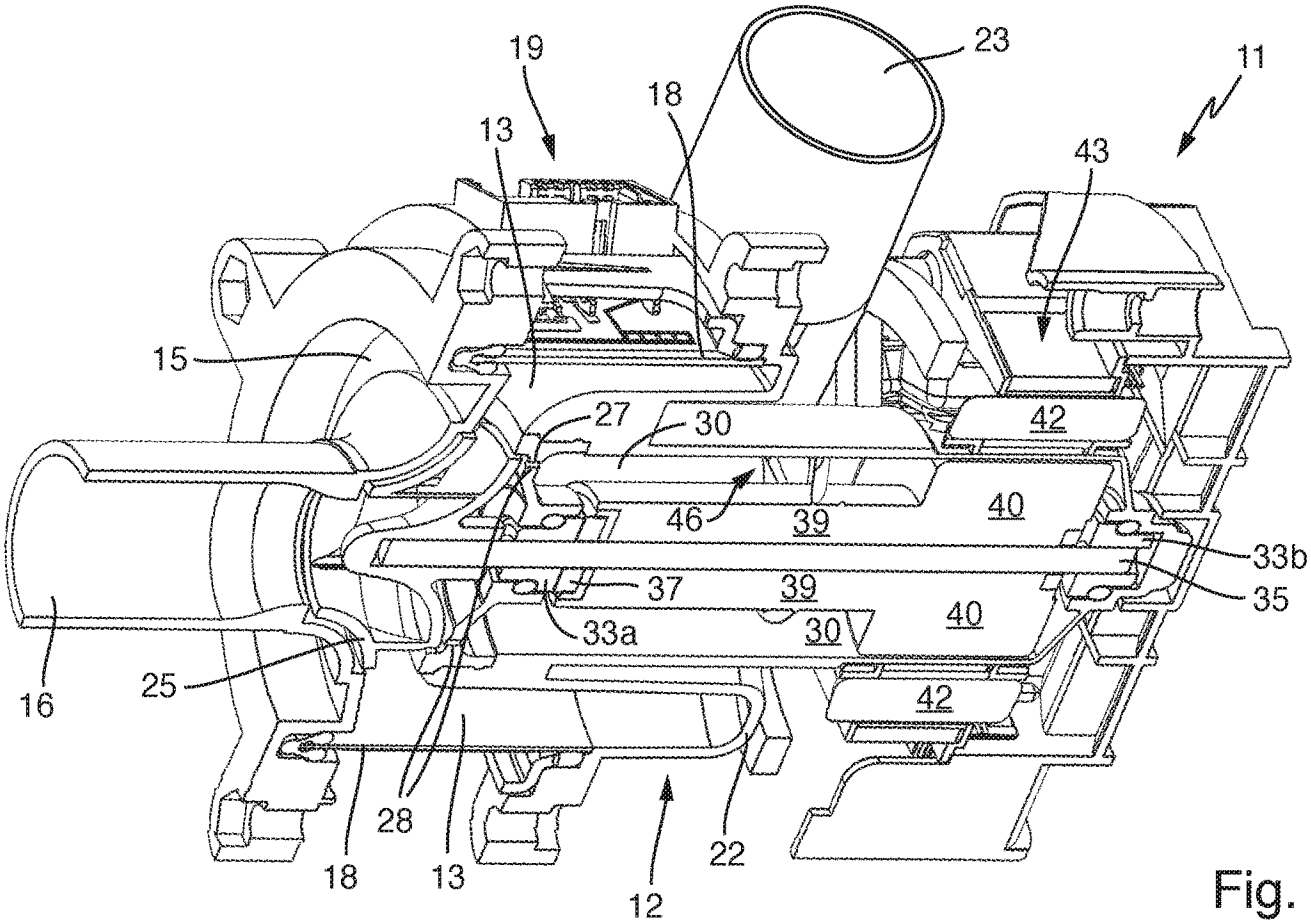
FIG. 2 shows an oblique sectional illustration of the pump from FIG. 1.
Figure 3:
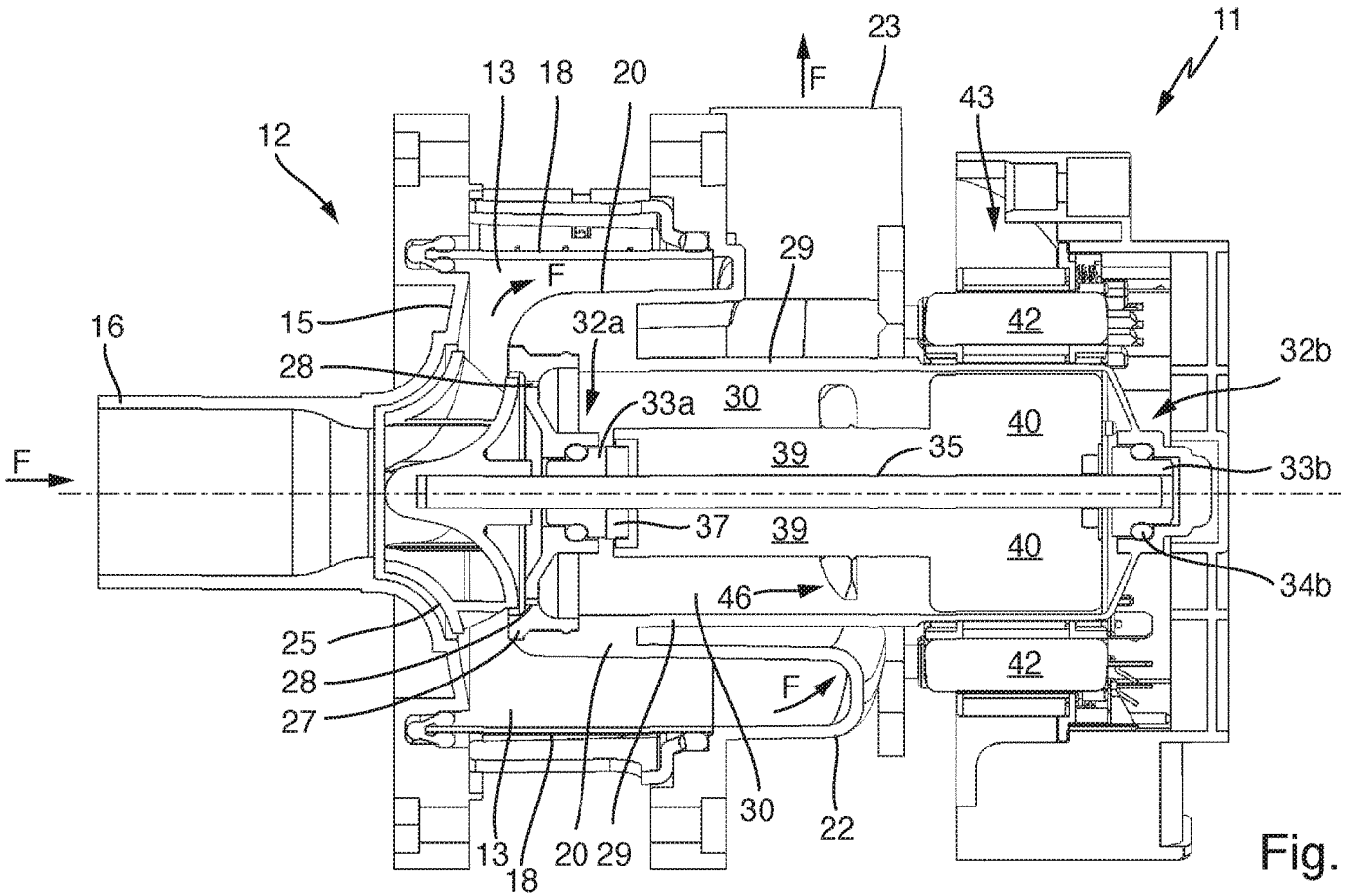
FIG. 3 shows a plan view of the sectioned view from FIG. 2.

FIG. 1 shows an oblique view of a pump 11 according to the invention having a pump housing 12 which has a pump chamber 13 which can be seen more clearly in the sectional illustrations of FIGS. 2 and 3. The pump 11 has an inlet nozzle 16 in a pump chamber cover 15, and an impeller 25 beneath said inlet nozzle 16. Furthermore, an outlet 22 out of the pump chamber 13 with an outlet nozzle 23 is provided in the general delivery direction F of the delivered fluid. This outlet 22 or outlet nozzle 23 is clearly at a distance from the pump chamber cover 15 and the inlet nozzle 16 in the axial direction. In particular, when looking at the axial extent along the longitudinal center axis of the pump 11, which longitudinal center axis is illustrated by a dashed and dotted line in FIG. 3, said outlet or outlet nozzle is provided at the other axial end of the pump chamber 13 from the inlet nozzle 16 and the impeller 25.

FIG. 1 also further shows the outer face of a heating device 18 with strip-like heating conductor tracks 18', as is known from EP 2150165 B1 which was cited in the introductory part. Said outer face can then be, as it were, exposed toward the outside, but as an alternative it can also be thermally insulated as a safety measure and also in order to reduce waste heat from the pump 11 passing to the outside and in order to increase the thermal efficiency of the pump. A connection plug 19 for the pump 11 is provided at the top of the pump housing 12 close to the outlet nozzle 23.

The pump chamber 13 is delimited by an encircling inner wall 20 toward the inside. This inner wall 20 is of non-concentric design and creates a varying width or varying cross-sectional area in the circumferential direction of the pump chamber 13. This is known, for example, from German patent application DE 102012210554.9 with the application date of Jul. 22, 2012 by the same applicant.

The impeller 25 is arranged above a cover 27 which forms a kind of pump chamber base or at least the central region of said pump chamber base with respect to the pump chamber 13. At the same time, said cover closes the auxiliary chamber 29, which is formed to the right of it within the pump chamber 13, as an abovementioned cylinder section which contains an additional fluid volume 30. The auxiliary chamber 29 is closed and therefore sealed toward the right, wherein it forms a mount 32*b* for a rotor shaft 35. To this end, the mount 32*b* or the base, which is arranged on the right, of the auxiliary chamber 29 is formed as a kind of end plate with a recess and a right-hand-side bearing bushing 33*b* therein.

A left-hand-side mount 32*a* in which a bearing bushing 33*a* is held in the cover 27 or as a mount 32*a*, is formed on the left-hand side in the cover 27. The bearing bushing 33*a* forms a radial bearing for the rotor shaft 35. At the same time, an axial bearing ring 37 is further arranged on or pressed against the rotor shaft 35. Said axial bearing ring bears against the bearing bushing 33*a* by way of its left-hand-side end face and also forms an axial bearing of the rotor shaft 35 on the left-hand side or in the direction of the inlet nozzle 16.

A holding body 39 which merges to the right with a rotor 40 of a drive motor 43 for the pump 11 is fastened on the rotor shaft 35. A stator 42 of the drive motor 43 is provided around the rotor 40 outside the auxiliary chamber 29. An impeller wheel 46 with blades is arranged on the holding body 39 and therefore on the rotor shaft 35, as is known per se for propellers.

The same fluid which is delivered by the pump 11 is provided in the auxiliary chamber 29 or as an additional fluid volume 30. To this end, the cover 27 has a plurality of passages 28. Said passages have the effect that the auxiliary chamber 29 is filled with the fluid. The impeller wheel 46 should be designed overall such that, as described in the introductory part, it generates such a force along the longitudinal center axis, which is illustrated by a dashed and dotted line, of the pump 11 or along the rotor shaft 35 toward the right within the fluid volume 30 during rated operation of the pump 11 that said force compensates for the corresponding force of the impeller 25 which is directed precisely opposite toward the left. The remaining axial force toward the left can be absorbed by the axial bearing with the bearing bushing 33*a* and the axial bearing ring 37.

FIG. 3 also further clearly shows how the fluid passes along a fluid path F first through the inlet nozzle 16 into the pump 11, specifically first into the impeller 25. From said impeller, said fluid is then output with a predominantly radial component, wherein, on account of the shaping of the impeller 25, it can be seen that there is still an albeit low but significant axial component, specifically even in the previous axial direction. Said impeller is therefore a so-called diagonal flow impeller and the pump 11 is a diagonal flow pump. Maintaining the axial movement component of the delivered fluid after said fluid is output from the impeller 25 can be assisted by the shape of the pump chamber cover 15 on the inner face in addition to the shaping of the impeller 25. In an alternative and advantageous manner, the impeller can be in the form of a purely radial impeller and therefore the pump can be in the form of a purely radial pump. A purely radial impeller is expected to be more efficient. The axial flow or axial component can be achieved by the shape of the pump chamber cover and the displacement of the water during the continuous delivery process in the case of purely radial design.

The delivered fluid circulates several times, for example 3 times to 8 times, in the annular pump chamber 13, but in the process moves continuously along the axial direction toward the right, and therefore further has an axial movement component. Finally, the circulating fluid which is delivered in the axial direction enters the outlet 22 along the fluid path F and is discharged from the pump chamber 13 or the pump 11 from the outlet nozzle 23. In this region, the delivered fluid no longer has an axial movement component in the illustrated exemplary embodiment. However, this does not have to be the case since, on account of the oblique gradient at the outlet 22 which can be seen, there is still an axial movement component of this kind up to just in front of the outlet nozzle 23. Therefore, the outlet nozzle 23 could also maintain this oblique direction.

It can also be seen in FIG. 3 that, according to a further generally applicable definition of the invention, the outlet 22 or the outlet nozzle 23 is arranged between the impeller 25 and at least one stator 42 of the drive motor 43 of the pump 11. Since the functional part of the rotor 40 of the drive motor 43 has approximately the axial extent of the stator 42, the outlet 22 or the outlet nozzle 23 is arranged between the impeller 25 on the one hand and the functional part of the drive motor 43 on the other hand in the axial direction.

Figure 4:
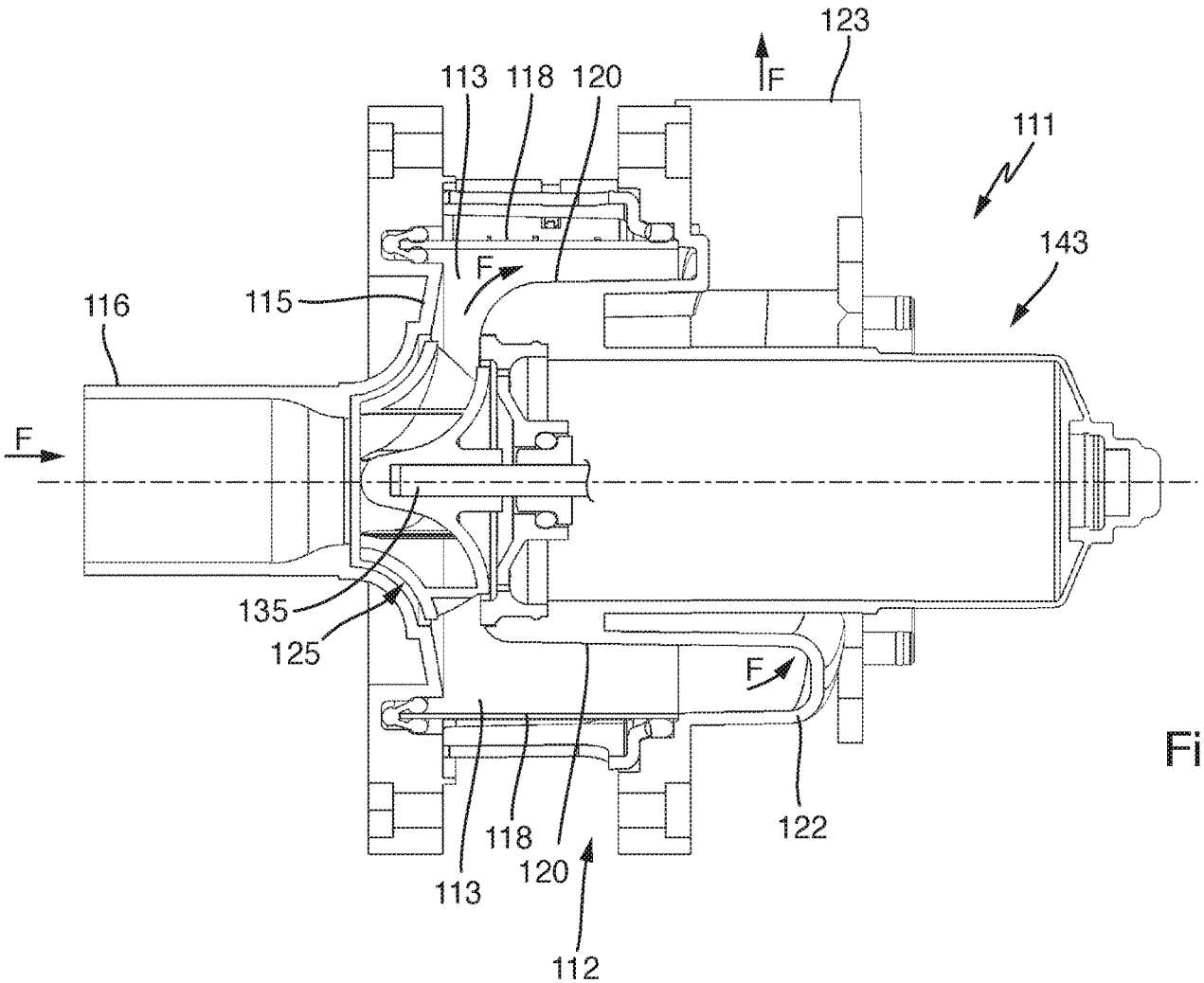

An alternative exemplary embodiment of the invention is shown in FIG. 4. In said figure, a pump 111 with a pump housing 112 has a structure which is similar in respect of the pure pump function, with a pump chamber 113 which is closed by a pump chamber cover 115 toward the left. An inlet nozzle 116 is arranged or integrally formed in the pump chamber cover 115. The pump chamber 113 is delimited or formed in the circumferential direction by an annular heating device 118 in accordance with the first exemplary embodiment. An inner wall 120 delimits the pump chamber 113 radially toward the inside.

The inlet nozzle 116 leads precisely to an impeller 125 which is mounted on a rotor shaft 135 of a drive motor 143. The rotor shaft 135 and the drive motor 143 are arranged on the longitudinal center axis of the pump 111, which longitudinal center axis is illustrated by a dashed line. In this case, the drive motor 143 is purely schematically illustrated and projects further into the pump or extends as far as just in front of a bottom face of the impeller 125.

Furthermore, said figure shows how the pump chamber 113 merges with an outlet 122 with an outlet nozzle 123 in the axial direction toward the right. This corresponds to the first exemplary embodiment. Therefore, it can also be seen here that, owing to the arrangement of the drive motor 143 as far as just below the impeller 125, the outlet 122 or the outlet nozzle 123 is no longer arranged between the impeller and the drive motor but rather is located at the axial height of the drive motor 143 here, specifically approximately in the center in relation to said drive motor. A good design and primarily a compact construction are also achieved in this way.

Furthermore, the drive motor 143 could even be considerably shorter in the axial direction, so that it hardly projects out of the pump chamber 113 or out of the pump housing 112 for example. In this case, it would be possible according to a further generally applicable idea of the present invention for a drive motor of the pump to be located closer to the impeller as seen in the axial direction, in particular with a significant part of its axial longitudinal extent, than an outlet or outlet nozzle of the pump housing.

Figure 5:
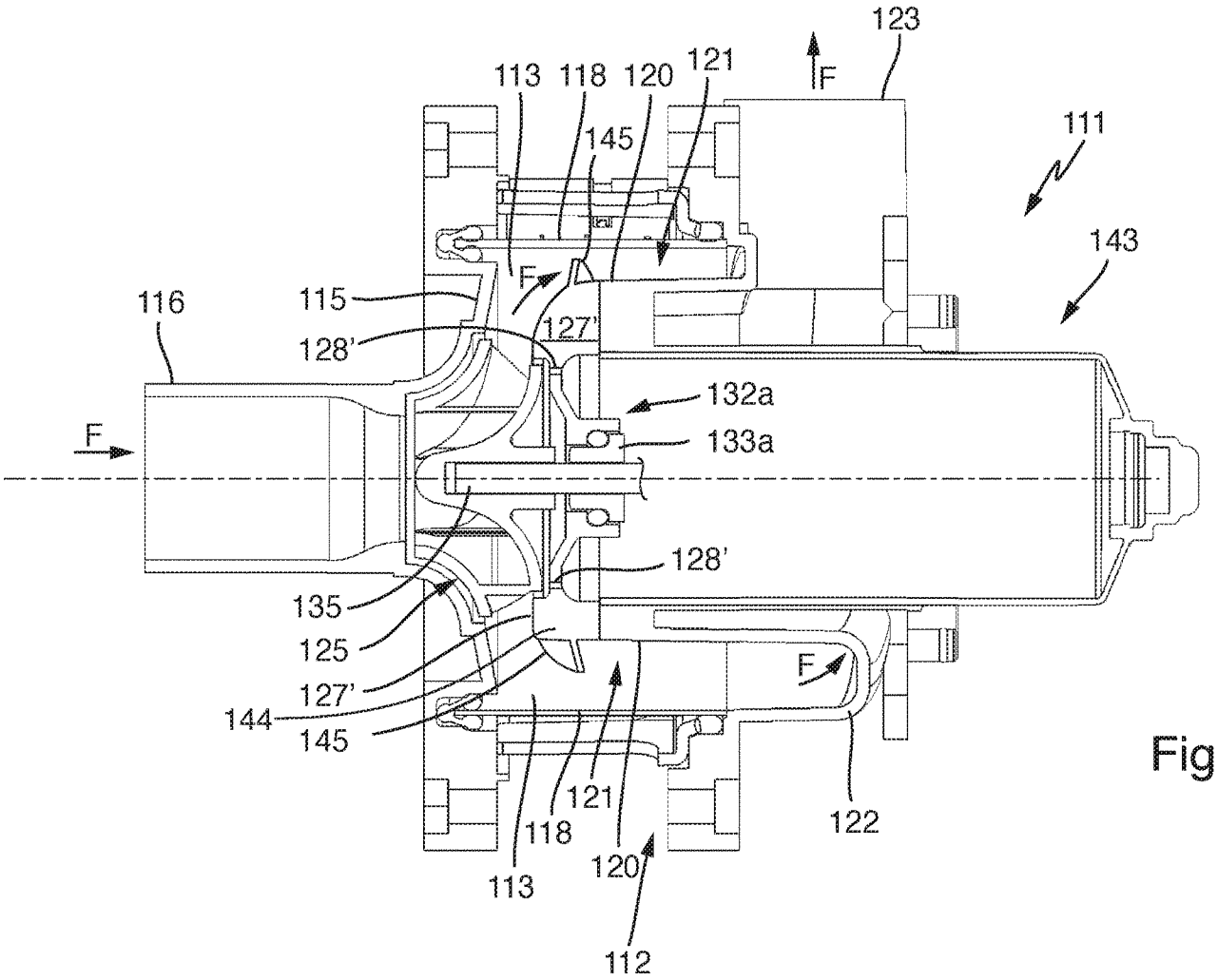
FIG. 5 shows a modification of the pump of FIG. 4 with a guide wheel.

FIG. 5 shows a modification to the pump 111 from FIG. 4, wherein here a separate cover 127' which covers or closes the hollow space in the cylinder section 121 is arranged on the cylinder section 121, which at the same time forms the abovementioned inner wall 120, at the free end which faces toward the left. In principle, this cover 127' corresponds to the cover 27 which is shown, for example, in FIG. 3, except said cover is now not inserted into the front end face opening but rather covers the entire cylinder section 121 and is mounted from the front. The passages 128' are also formed in said cover.

As shown in FIG. 5, a guide wheel 144 includes guide vanes 145, which project toward the outside or into the pump chamber 113 are arranged on the outside of the cover 127', of which the guide wheel 144 forms at least a portion (e.g., at least the left-hand portion of the cover 127', as shown). The guide vanes 145 are integrally formed on the cover 127'. However, said guide vanes could also be mounted on the outside in the manner of a ring. There are advantageously four guide vanes 145 which each extend in the circumferential direction scarcely over a quadrant and are inclined and of which the height amounts to somewhat less than the height of the cover 127' in terms of axial length. A different number of guide vanes, for example 2 to 6 or even 10, is also generally and advantageously possible. As illustrated here, the guide vanes 145 can point or be bent to a certain extent in the direction away from the inlet 116 in order to have as good as possible an effect or guiding effect for the conveyed fluid in the pump chamber 113. However, this does not necessarily have to be the case; they can also project at a right angle or point in the opposite direction.

Furthermore, it can also be seen in FIG. 5 that the cover 127' runs precisely in an extension of the section 120 and is mounted virtually at the front of said section, and the guide vanes 145 project laterally toward the outside from the cover 127' with a constant height. Therefore, although said guide vanes are in principle of identical design in relation to one another, they are each at a different distance from the heating device 118 as the outer wall of the pump chamber 113. Therefore, said guide vanes are also non-concentric in relation to the longitudinal center axis of the pump 111 which is illustrated by a dashed and dotted line. This simplifies the design and may be desirable in terms of flow. As an alternative, it is also possible in the case of a section 121 which is arranged off-center as illustrated here and has an inner wall 120 which is provided off-center to design the guide vanes 145 at in each case the same distance from the heating device 118 as the outer wall, for example 1 mm to 5 mm or even possibly 10 mm. The cover 127' also has the mount 132*a* with the left-hand-side bearing bushing 133*a*, as is already the case in FIG. 4.

The invention claimed is:

1. An impeller pump for delivering fluid, the impeller pump comprising:

a pump housing;

a pump chamber in the pump housing;

an inlet into the pump chamber and an outlet out of the pump chamber;

a drive motor;

a rotor shaft coupled to the drive motor;

an impeller in the pump chamber, wherein the impeller is arranged on the rotor shaft and is connected to the drive motor of the impeller pump;

a pump chamber cover and a pump chamber base, wherein the inlet is arranged in the pump chamber cover, wherein the outlet is arranged below the impeller in an axial direction of the impeller pump parallel to the rotor shaft at an end region of the pump chamber remote from the inlet, wherein the impeller is arranged above an end face of a projection or an end face of a cylinder section, which projects into the pump chamber and, from an end of the impeller pump remote from the pump chamber cover, projects into the pump chamber in the axial direction and forms an inner wall of the pump chamber, wherein the projection or the cylinder section is integrally connected to a part forming an outer wall of the pump chamber, wherein a guide wheel with at least one guide vane extending along an outer face of the guide wheel is provided on the projection or cylinder section adjacent to the end face or at a free end of the projection or cylinder section above which the impeller is arranged, wherein the guide vane projects outwardly and at least one part of the circumferential direction extends along the outer face, and the guide vane is inclined relative to a longitudinal center axis extending through the rotor shaft, wherein the projection or cylinder section is hollow and a cover is fitted onto the projection or cylinder section, wherein the at least one guide vane is arranged on an outside of an outer face on the cover, and wherein the cover comprises a mount for the rotor shaft in the central region.

2. The impeller pump according to claim 1, further comprising a heater for fluid delivered by the impeller pump, wherein the heater is integrated into the pump chamber and is annular and forms the outer wall of the pump chamber.

3. The impeller pump according to claim 1, wherein the impeller is arranged below the pump chamber cover, and wherein no region of the pump chamber projects beyond the impeller in the axial direction toward the inlet.

4. The impeller pump according to claim 1, wherein the pump chamber, starting from the pump chamber cover, extends away from the inlet in the axial direction in an annularly encircling manner, the pump chamber having a length along the axial direction ranging from 0.5 times to 1.5 times a largest diameter of the pump chamber or ranging from 2 times to 5 times an axial length of the impeller.

5. The impeller pump according to claim 1, wherein the rotor shaft leads through the projection or cylinder section of the impeller pump, and wherein the projection or cylinder section contains a rotor of the drive motor, wherein the rotor sits on the rotor shaft.

6. The impeller pump according to claim 1, wherein the pump housing comprises three parts and is formed by the pump chamber cover, a radially outer pump chamber wall or a heater, and the projection or cylinder section, and wherein the projection or cylinder section is below the outlet and drawn upward radially outward in a direction of the inlet as far as the outer wall of the pump chamber.

7. The impeller pump according to claim 1, wherein the impeller is arranged a distance of less than 5 mm above the cover.

8. The impeller pump according to claim 1, wherein the cover has a bearing support for a running bearing of the rotor shaft, and the bearing support forms a mount for a bearing bushing for the rotor shaft.

9. The impeller pump according to claim 1, wherein the cover is configured to be off-center in relation to a longitudinal center axis extending through the rotor shaft.

10. The impeller pump according to claim 1, wherein a delivery direction of fluid delivered within the pump housing never runs opposite to an inflow direction through the inlet into the pump chamber, wherein the delivery direction always has an axial component along the axial direction at the outlet until the fluid delivered leaves the pump chamber at the outlet, and wherein an axial movement component of the fluid delivered in the delivery direction of greater than zero is also present in the impeller.

* * * * *